US006896028B2

(12) United States Patent
Brennan

(10) Patent No.: US 6,896,028 B2
(45) Date of Patent: May 24, 2005

(54) PRIVACY SCREEN ASSEMBLY

(75) Inventor: Gareth J. Brennan, Etobicoke (CA)

(73) Assignee: Leef Inc., Toronto (CA)

( * ) Notice: Subject to any disclaimer, the term of this patent is extended or adjusted under 35 U.S.C. 154(b) by 0 days.

(21) Appl. No.: 10/347,830

(22) Filed: Jan. 21, 2003

(65) Prior Publication Data

US 2004/0140066 A1 Jul. 22, 2004

(51) Int. Cl.[7] ..... A47G 5/00
(52) U.S. Cl. ..... 160/351
(58) Field of Search ..... 160/135, 351, 160/352, 229.1; 52/239; 40/606, 610

(56) References Cited

U.S. PATENT DOCUMENTS 2,425,466 A * 8/1947 Gregory ..... 160/135
3,463,218 A * 8/1969 Cannon et al. ..... 160/135
3,875,711 A * 4/1975 Palmer ..... 160/135 X
4,200,254 A * 4/1980 Nelson ..... 160/351 X
4,373,570 A * 2/1983 Nussdorf et al. ..... 160/352
4,516,620 A * 5/1985 Mulhern ..... 160/351
4,774,792 A * 10/1988 Ballance ..... 52/239 X
4,928,465 A 5/1990 Del Castillo Von Haucke
5,031,683 A * 7/1991 Marvy et al. ..... 160/351
5,287,909 A 2/1994 King et al.
5,680,893 A 10/1997 Neer
5,730,666 A 3/1998 Hudson
5,771,954 A * 6/1998 Benner et al. ..... 160/351 X
5,875,597 A 3/1999 Gingrich et al.
5,966,879 A 10/1999 Verbeek et al.
6,032,684 A 3/2000 Narron
6,068,041 A 5/2000 Miles et al.
6,116,326 A * 9/2000 Domina et al. ..... 160/351
6,152,567 A 11/2000 LaForgia
6,279,761 B1 8/2001 Niewiadomski et al.
6,374,547 B1 4/2002 Baloga et al.
6,427,389 B1 8/2002 Branc et al.
6,533,019 B1 * 3/2003 King et al. ..... 160/351
6,598,649 B1 * 7/2003 Moore et al. ..... 160/135

* cited by examiner

*Primary Examiner*—David Purol
(74) *Attorney, Agent, or Firm*—Connolly Bove Lodge & Hutz LLP

(57) ABSTRACT

A portable privacy screen assembly includes a frame assembly having a tubular frame, a wheel set adjacent one bottom corner of the tubular frame and a base plate adjacent an opposite bottom corner of the tubular frame. The wheel set and base plate support the tubular frame in a generally upright condition. A screen is releasably supported by the tubular frame and has opposed major surfaces. At least one of the opposed major surfaces is a dry-erase marker erasable writing surface.

31 Claims, 5 Drawing Sheets

PRIVACY SCREEN ASSEMBLY

FIELD OF THE INVENTION

The present invention relates generally to privacy screen assemblies, partitions or dividers and in particular to a privacy screen assembly having a screen providing at least one writing surface. The present invention also relates to a reorientable privacy screen assembly and to a method of assembling a privacy screen.

BACKGROUND OF THE INVENTION

Privacy screen assemblies, dividers and partitions (hereinafter collectively referred to as "privacy screen assemblies") are well known in the art and many variations exist. For example, U.S. Pat. No. 5,875,597 to Gingrich et al discloses a height-adjustable space-dividing screen assembly comprising a pair of height-adjustable supports posts and a flexible fabric screen having opposite ends connected to the support posts. The support posts include vertically moveable tubes to enable the height of the screen to be adjusted.

U.S. Pat. No. 4,928,465 to Del Castillo Von Haucke discloses a modular privacy screen assembly including one or more panels joined together by vertical consolidating members.

U.S. Pat. No. 5,680,893 to Neer discloses a decorative privacy screen assembly having an aesthetically pleasing decorated screen.

U.S. Pat. No. 6,068,041 to Miles et al discloses an adjustable partition assembly including a pair of pivotally coupled base barrier members. A pair of slidable telescoping barrier members is connected to each base barrier member. In one embodiment, one of the slidable telescoping barrier members includes a marker board surface.

Although the above-mentioned references disclose privacy screen assemblies, improved privacy screen assemblies to delineate space are desired. It is therefore an object of the present invention to provide a novel privacy screen assembly.

SUMMARY OF THE INVENTION

According to one aspect of the present invention there is provided a privacy screen assembly comprising:

a screen having opposed major surfaces, at least one of said opposed major surfaces being an erasable writing surface; and a screen support supporting said screen in a vertical orientation.

Preferably both of the opposed major surfaces are erasable writing surfaces. It is also preferred that the screen is formed of acrylic and is either opaque, translucent or transparent. When the screen is transparent, the screen provides a good tracing surface.

In one preferred embodiment, the screen support is in the form of a frame assembly that surrounds the screen. The frame assembly releasable supports the screen allowing the screen to be replaced easily. The frame assembly includes a tubular frame having a wheel set at one bottom corner of the frame and a support plate at an opposite bottom corner of the frame.

According to another aspect of the present invention there is provided a portable privacy screen assembly comprising:

a frame assembly having a base assembly to support said frame assembly in a generally vertical condition; and a screen surrounded and supported by said frame assembly, said screen having opposed major surfaces at least one of which is an erasable writing surface.

According to yet another aspect of the present invention there is provided a portable privacy screen assembly comprising:

a frame assembly having a tubular frame, a wheel set adjacent one bottom corner of said tubular frame and a base plate adjacent an opposite bottom corner of said tubular frame, said wheel set and base plate supporting said tubular frame in a generally upright condition; and a screen releasably supported by said tubular frame, said screen having opposed major surfaces at least one of which is an erasable writing surface.

According to yet another aspect of the present invention there is provided a privacy screen assembly comprising:

a frame having a wheel set adjacent one corner thereof and a base plate adjacent an opposite corner thereof, said base plate being releasably attachable to said frame adjacent different corners of said frame to enable said frame to assume different orientations when supported on said wheel set and base plate; and a screen disposed over said frame.

Preferably, the frame assumes either a horizontal or vertical orientation depending on the location of the base plate. In a preferred embodiment, the screen is formed of a stretchable material pulled over the frame and the frame is constituted by mating frame portions.

According to still yet another aspect of the present invention there is provided a privacy screen assembly comprising:

a frame assembly;

a wheel set adjacent a first corner of said frame assembly;

a first attachment plate adjacent a second corner of said frame assembly;

a second attachment plate adjacent a third corner of said frame assembly, said second and third corners defining diametric corners of a triangle;

a base plate releasably attachable to one of said first and second attachment plates; and a screen disposed over said frame assembly.

The present invention is advantageous in that in one form it provides a unique alternative to traditional writing surfaces. When both major surfaces of the screen are erasable writing surfaces, writing can be placed on both writing surfaces simultaneously. When the screen is transparent, the screen provides a good tracing surface. Since the screen is releasably held by the frame assembly, the screen can be easily removed and replaced.

The present invention provides further advantages in that since the privacy screen is reorientable, it is versatile making it suitable for use in a number of environments. Furthermore, the privacy screen assembly can be constructed quickly and easily.

BRIEF DESCRIPTION OF THE DRAWINGS

Embodiments of the present invention will now be described more fully with reference to the accompanying drawings in which.

DETAILED DESCRIPTION OF THE PREFERRED EMBODIMENTS

Figure 1:
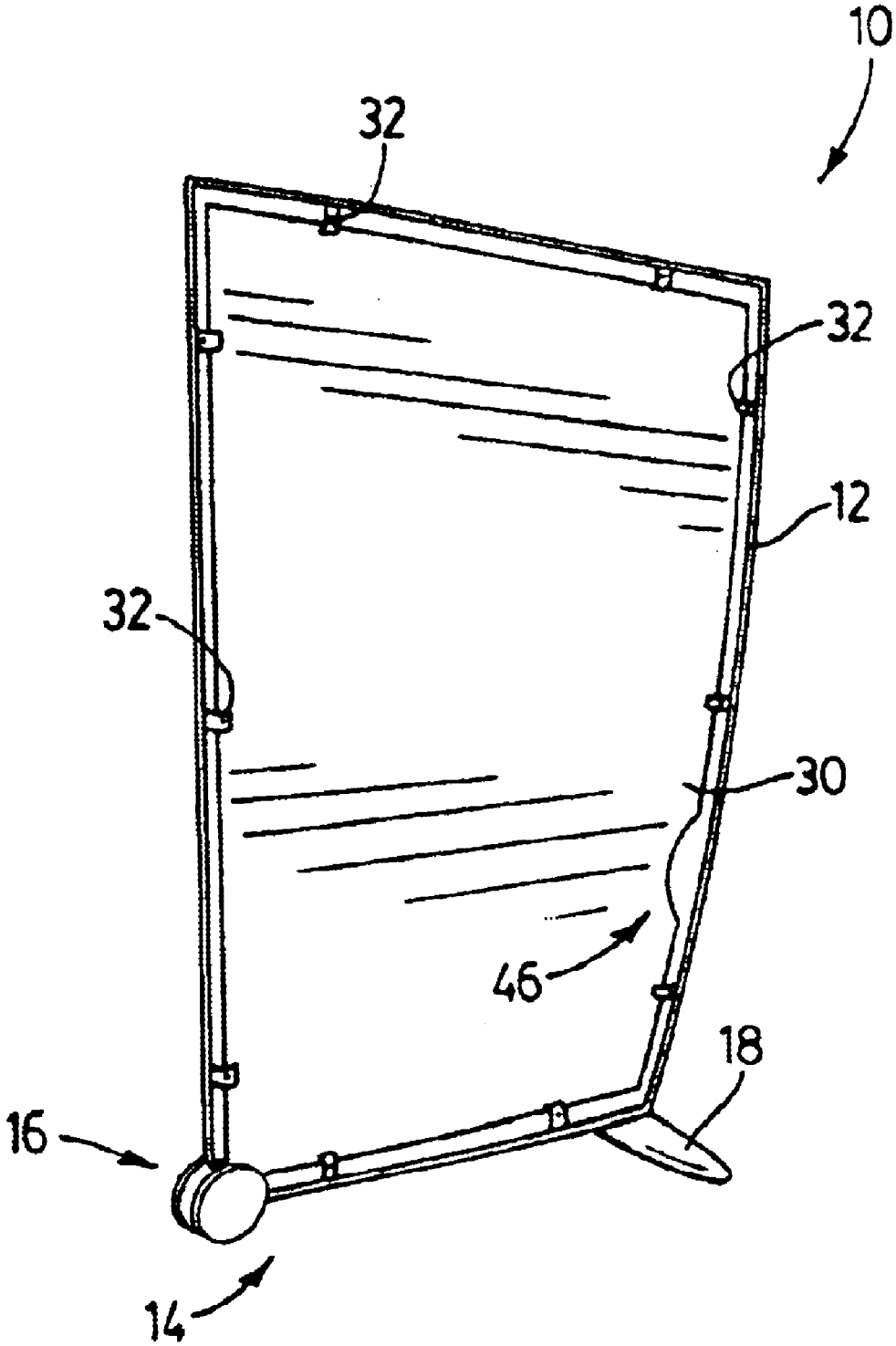
FIG. 1 is a perspective view taken from above and from the side of a privacy screen assembly in accordance with the present invention.

Turning now to FIG. 1, a privacy screen assembly in accordance with the present invention is shown and is generally identified by reference numeral 10. As can be seen, privacy screen assembly 10 includes a thin profile, square tubular frame 12 having a "sail-like" appearance. The frame 12 is supported in a generally vertical orientation by a base assembly 14 that includes a wheel set 16 and a base plate 18 positioned at opposite bottom corners of the frame.

Figure 4:
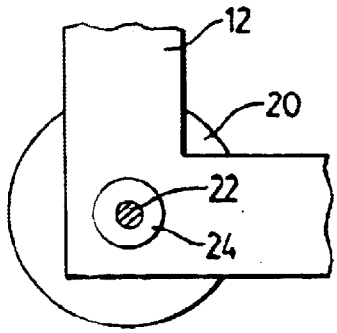
FIG. 4 is a side elevational view, partly in section, of a portion of the privacy screen assembly.

Wheel set 16 includes a pair of polypropylene wheels 20 positioned on opposed sides of the frame 12. Each wheel 20 has a powder coated steel cover provided primarily for aesthetics. An axle 22 (see FIG. 4) passes through a bushing 24 accommodated by the frame 12 and interconnects the wheels 20. The base plate 18 is generally ovate and thin to provide a low profile, unobtrusive support.

Figure 2:
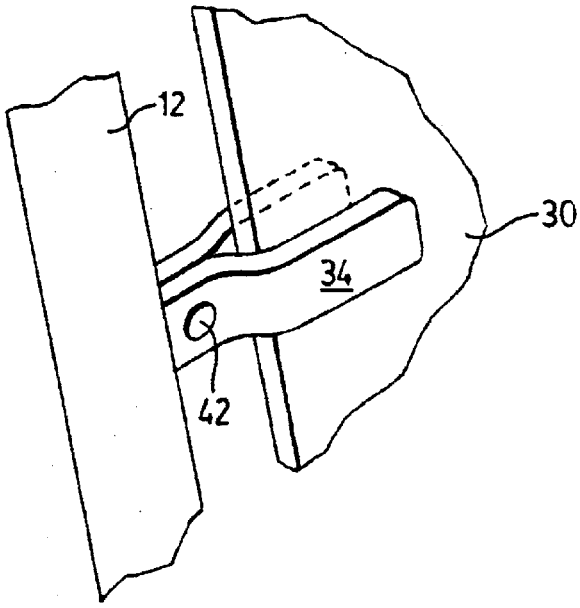
FIG. 2 is a perspective view of a clamp assembly forming a portion of the privacy screen assembly of FIG. 1.
Figure 3:
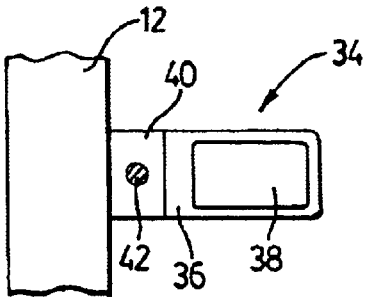
FIG. 3 is a side elevational view of a portion of the clamp assembly of FIG. 2.

A screen 30 is surrounded by the frame 12 and is releasably secured to the frame 12 by clamp assemblies 32 located at spaced locations about the frame 12 (best seen in FIGS. 2 and 3). Each clamp assembly 32 includes a pair of clamping elements 34 having a lazy-S configuration. Each pair of clamping elements 34 defines a pair of facing clamping surfaces 36 between which the screen 30 is sandwiched. Pads 38 are provided on the clamping surfaces 36 to protect the screen 30. Each pair of clamping elements 34 is secured to an inwardly extending flange 40 on the frame 12 by a releasable fastener 42, in this case a nut and bolt. The releasable clamp assemblies 32 allow the screen 30 to be easily removed from the frame 12 and replaced.

Screen 30 in this embodiment is formed of coloured translucent acrylic and provides a pair of opposed erasable writing or marker surfaces 44 for use with dry erase markers. An indent 46 is provided in the side of the screen 30 above the base plate 18 to facilitate grasping of the frame 12.

The privacy screen assembly 10 provides a unique alternative to traditional writing surfaces and can be used as a stand alone unit or a divider to delineate areas such as desks, workstations and work surfaces. During use, the privacy screen assembly 10 is placed at the desired location to delineate the area of interest. Moving the privacy screen assembly 10 is easy. A user is simply required to grasp the frame 12 adjacent the indent 46, lift the frame to suspend the base plate 18 above the ground surface and then roll the frame 12 via the wheel set 16 to the desired location. Once in position, not only does the privacy screen assembly 10 delineate an area but provides users with erasable writing surfaces for use with dry erase markers. In the present embodiment, since both major surfaces 44 of the screen 30 provide writing surfaces, users on opposite sides of the screen 30 are able to write simultaneously on the writing surfaces.

Figure 5:
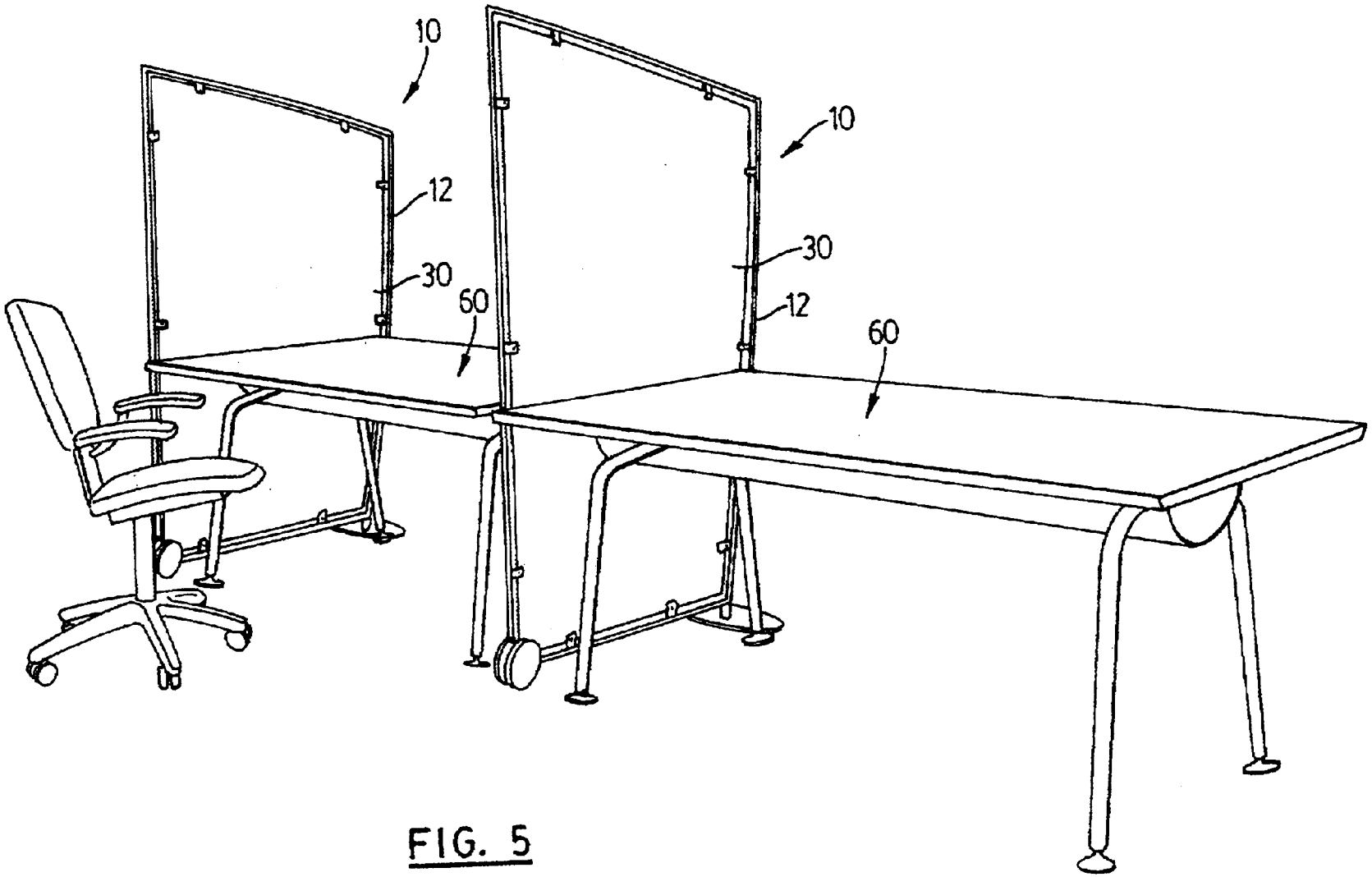
FIG. 5 is a perspective view of a plurality of privacy screen assemblies dividing a pair of workstations.

The privacy screen assembly 10 is useful in a variety of environments such as offices, hospitals, educational institutions, exhibitions and airports. For example, FIG. 5 shows a plurality of privacy screen assemblies 10 used to divide desks 60.

Figure 6:
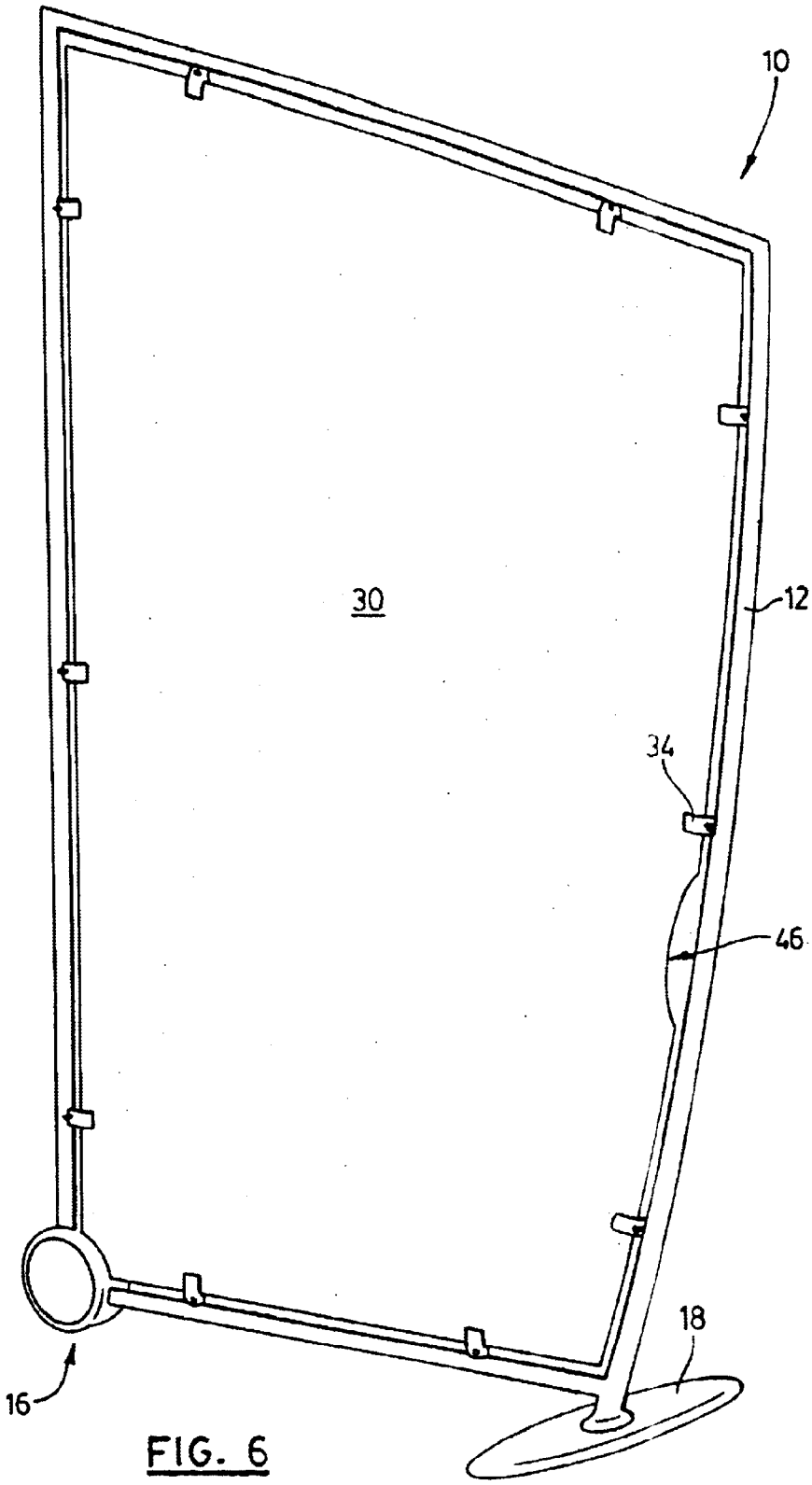
FIG. 6 is a perspective view taken from above and from the side of an alternative embodiment of a privacy screen assembly in accordance with the present invention.

Although the screen 30 is described as being coloured, translucent and formed of acrylic, those of skill in the art will appreciate that the screen 30 make take other forms. For example, the screen 30 may be clear or opaque. When the screen 30 is clear as shown in FIG. 6, the screen provides an ideal surface on which to trace drawings or documents. Also, the screen may be formed of other suitable materials that support writing using a dry erase marker or other writing utensil. Furthermore, the screen may be constructed to provide only one erasable writing surface.

The shape and size of the privacy screen assembly can of course be changed to suit the particular environment. For example, if the privacy screen assembly is to be supported on a desk or other similar surface, the height of the privacy screen assembly can be greatly reduced. Also, the base assembly can be altered to allow the privacy screen to be clamped onto the desk surface.

Turning now to FIGS. 7 to 10 another embodiment of a privacy screen assembly in accordance with the present invention is shown. In this embodiments, like reference numerals will be used to identify like components with a "100" added for clarity. As can be seen, similar to the previous embodiment, the privacy screen assembly 110 includes a thin profile, square tubular frame 112 having a "sail-like" appearance. Unlike the previous embodiment however, frame 112 is of a two part construction including a pair of mating frame portions 112*a* and 112*b* respectively. The frame portions 112*a* and 112*b* carry mating formations that allow the frame portions to engage in a snug snap fit.

Figure 10:
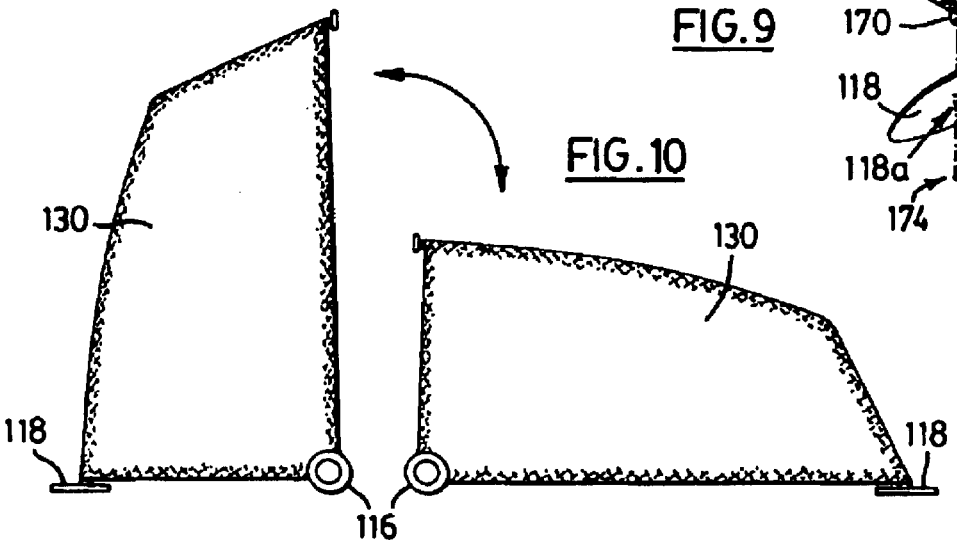
FIG. 10 show side elevational views of the privacy screen assembly of FIG. 7 in different orientations.

A wheel set 116 identical to that of the previous embodiment is positioned at one bottom corner of the frame 112. Circular attachment plates 170 and 172 are positioned at diametric corners of the frame 112. The attachment plates 170 and 172 provide releasable attachment surfaces for a thin profile, ovate base plate 118. Fasteners 174 pass through holes 118*a* in the base plate 118 and engage one of the attachment plates. Adjusting the position of the base plate 118 allows the privacy screen assembly 110 to take either a vertical orientation or a horizontal orientation as shown in FIG. 10. A stretchable screen 130 formed of fabric material is pulled over the frame 112 to complete the privacy screen assembly 110 allowing the privacy screen assembly to be used to delineate areas.

Figure 8:
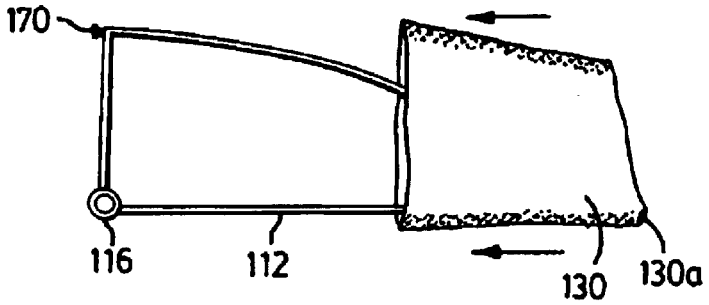
FIG. 8 is a side elevational view of a fabric stretchable screen being pulled over the privacy screen assembly frame of FIG. 7.
Figure 7:
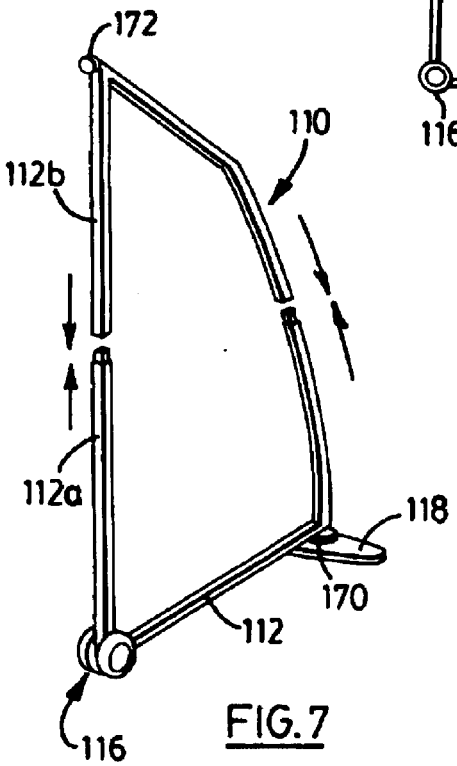
FIG. 7 is a perspective view of the frame of yet another embodiment of a privacy screen assembly in accordance with the present invention.
Figure 9:
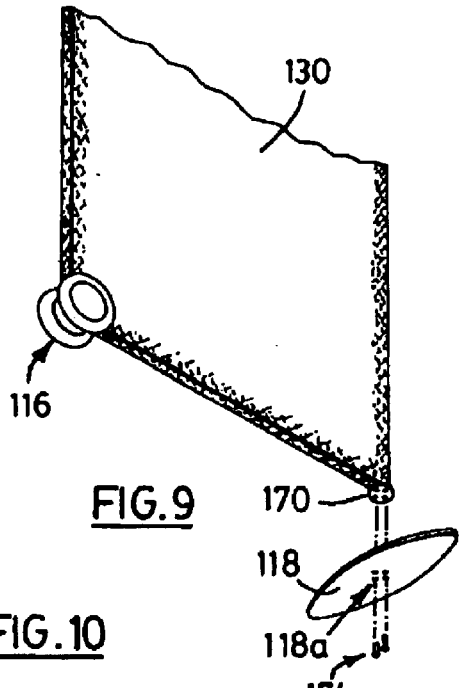
FIG. 9 is an exploded perspective view of a portion of the privacy screen assembly of FIG. 7.

Assembling the privacy screen assembly 110 is a simple task. Initially the frame portions 112*a* and 112*b* are engaged to complete the frame 112. The fabric screen 130 is then pulled over the frame 112 as shown in FIG. 8. An opening 130*a* is provided in one cornet of the fabric screen 130 to accommodate the attachment plate 172. With the fabric screen 130 in place, the base plate 118 is fastened to the appropriate attachment plate 170 or 172 allowing the privacy screen assembly to assume the desired orientation.

As will be appreciated, the privacy screen assembly 110 can be easily and quickly assembled. Since the position of the base plate 118 can be changed, the privacy screen assembly 110 can be oriented either horizontally or vertically making the privacy screen assembly versatile and suitable for use in a number of environments.

Although preferred embodiments of the present invention have been described, those of skill in the art will appreciate that variations and modifications may be made without departing from the spirit and scope thereof as defined by the appended claims.

What is claimed is:

1. A privacy screen assembly comprising:

a screen having opposed major surfaces, at least one of said opposed major surfaces being an erasable writing surface;

a frame assembly surrounding said screen;

a base assembly supporting screen and frame assembly in a generally vertical orientation, said base assembly including a wheel set and a base plate laterally spaced from said wheel set; and an indent in a side of said screen above said base plate.

2. A privacy screen assembly according to claim 1 wherein both of said opposed major surfaces are erasable writing surfaces.

3. A privacy screen assembly according to claim 2 wherein said screen is formed of acrylic.

4. A privacy screen assembly according to claim 3 wherein said screen is one of opaque, translucent and transparent.

5. A privacy screen assembly according to claim 1 wherein said frame assembly releasable supports said screen.

6. A privacy screen assembly according to claim 5 wherein said frame assembly includes a tubular frame.

7. A privacy screen assembly according to claim 6 wherein said wheel set is adjacent one bottom corner of said tubular frame and wherein said base plate is adjacent an opposite bottom corner of said tubular frame.

8. A privacy screen assembly according to claim 6 further comprising a plurality of clamp assemblies at spaced locations about said tubular frame, said clamp assemblies being releasably coupled to said tubular frame and engaging sides of said screen.

9. A privacy screen assembly according to claim 1 wherein said indent is defined by a smooth, shallow U-shaped curve formed in said screen.

10. A portable privacy screen assembly comprising:

a frame assembly having a base assembly to support said frame assembly in a generally vertical orientation; and a screen surrounded and supported by said frame assembly, said screen having opposed major surfaces at least one of which is an erasable writing surface, said screen further having an indent formed in a side thereof to facilitate grasping of said frame assembly.

11. A privacy screen assembly according to claim 10 wherein both of said opposed major surfaces are erasable writing surfaces.

12. A privacy screen assembly according to claim 10 wherein said screen is one of opaque, translucent and transparent.

13. A privacy screen assembly according to claim 10 wherein said frame assembly releasable supports said screen.

14. A privacy screen assembly according to claim 13 wherein said base assembly includes a wheel set adjacent one bottom corner of said frame assembly and a planar base plate adjacent an opposite bottom corner of said frame assembly.

15. A privacy screen assembly according to claim 14 further comprising a plurality of clamp assemblies at spaced locations about said frame assembly, said clamp assemblies being releasably coupled to said frame assembly and engaging sides of said screen.

16. A privacy screen assembly according to claim 15 wherein said indent is formed in the side of said screen above said base plate.

17. A privacy screen assembly according to claim 10 wherein said indent is defined by a smooth, shallow U-shaped curve formed in said screen.

18. A portable privacy screen assembly comprising:

a frame assembly having a tubular frame, a wheel set adjacent one bottom corner of said tubular frame and a base plate adjacent an opposite bottom corner of said tubular frame, said wheel set and base plate supporting said tubular frame in a generally upright condition; and a screen releasably supported by said tubular frame, said screen having opposed major surfaces at least one of which is an erasable writing surface and an indent formed in a side thereof above said base plate.

19. A privacy screen assembly according to claim 18 wherein both of said opposed major surfaces are erasable writing surfaces.

20. A privacy screen assembly according to claim 18 wherein said screen is one of opaque, translucent and transparent.

21. A privacy screen assembly according to claim 18 further comprising a plurality of clamp assemblies at spaced locations about said frame, said clamp assemblies being releasably coupled to said frame and engaging sides of said screen.

22. A privacy screen assembly according to claim 18 wherein said indent is defined by a smooth, shallow U-shaped curve formed in said screen.

23. A privacy screen assembly according to claim 22 wherein said indent is adjacent the mid-point of said side.

24. A privacy screen assembly comprising:

a frame having a wheel set adjacent one corner thereof and a base plate adjacent an opposite corner thereof, said base plate being releasably attachable to said frame adjacent different corners of said frame to enable said frame to assume different orientations when supported on said wheel set and base plate; and a screen disposed over said frame.

25. A privacy screen assembly according to claim 24 wherein said frame assumes either a vertical orientation or a horizontal orientation depending on the location of said base plate.

26. A privacy screen assembly according to claim 25 wherein said screen is formed of stretchable material that is pulled over said frame.

27. A privacy screen assembly according to claim 26 wherein said frame is constituted by mating frame portions.

28. A privacy screen assembly comprising:

a frame assembly;

a wheel set adjacent a first corner of said frame assembly;

a first attachment plate adjacent a second corner of said frame assembly;

a second attachment plate adjacent a third corner of said frame assembly, said second and third corners defining diametric corners of a triangle;

a base plate releasably attachable to one of said first and second attachment plates; and a screen disposed over said frame assembly.

29. A privacy screen assembly according to claim 28 wherein said screen is formed of stretchable material pulled over said frame assembly.

30. A privacy screen assembly according to claim 29 wherein said material is fabric.

31. A privacy screen assembly according to claim 30 wherein said frame assembly includes mating frame portions.

* * * * *